US011154097B2

(12) United States Patent
Frankel

(10) Patent No.: US 11,154,097 B2
(45) Date of Patent: Oct. 26, 2021

(54) APPARATUS TO ENHANCE SHIRT COLLAR APPEARANCE

(71) Applicant: Perky, LLC, Charlotte, NC (US)

(72) Inventor: David M. Frankel, Charlotte, NC (US)

(73) Assignee: Perky, LLC, Charlotte, NC (US)

( * ) Notice: Subject to any disclaimer, the term of this patent is extended or adjusted under 35 U.S.C. 154(b) by 0 days.

(21) Appl. No.: 14/996,782

(22) Filed: Jan. 15, 2016

(65) Prior Publication Data

US 2016/0206008 A1 Jul. 21, 2016

Related U.S. Application Data

(60) Provisional application No. 62/104,689, filed on Jan. 16, 2015.

(51) Int. Cl.
*A41B 3/06* (2006.01)
*A41B 3/08* (2006.01)

(52) U.S. Cl.
CPC . *A41B 3/06* (2013.01); *A41B 3/08* (2013.01)

(58) Field of Classification Search
CPC ..... A41B 3/06; A41B 3/08
See application file for complete search history.

(56) References Cited

U.S. PATENT DOCUMENTS 440,027 A * 11/1890 Gibble ..... A41B 3/06 2/132
463,884 A * 11/1891 Anderson ..... A41B 3/06 2/132
1,291,328 A * 1/1919 Williams ..... A41B 3/06 2/132
1,413,470 A * 4/1922 Getsinger ..... A41B 3/06 2/131
1,519,593 A * 12/1924 Schmidt ..... A41B 3/06 2/132
2,089,748 A * 8/1937 Herscovitch ..... A41B 3/06 2/132
2,515,802 A * 7/1950 Sato ..... A41B 3/06 2/132
2,724,836 A * 11/1955 Wiedemer ..... A41B 3/12 2/132
3,068,486 A * 12/1962 Gleeson ..... A41B 3/06 2/103
3,088,117 A * 5/1963 Baker ..... A41B 3/10 2/123
3,200,413 A * 8/1965 Vaughan ..... A41B 3/18 2/127
4,922,553 A * 5/1990 Morrone ..... A41D 27/08 2/129
6,889,387 B1 * 5/2005 Tiss ..... B65D 85/182 2/132
7,080,413 B1 * 7/2006 Schneider ..... A45D 44/08 2/50
8,296,865 B2 10/2012 Garcia
(Continued)

*Primary Examiner* — Khaled Annis
(74) *Attorney, Agent, or Firm* — Meunier Carlin & Curfman LLC

(57) ABSTRACT

A shirt collar adjustment and support apparatus defines a curved body having a first edge and a second edge that converge to define an opening between two endpoints. One of said edges is tapered at respective ends toward the endpoints to define tapered ends of the device defining an opening there between. The device is worn under a shirt collar to add support.

13 Claims, 10 Drawing Sheets

(56) References Cited

U.S. PATENT DOCUMENTS

| | | | | |
|---|---|---|---|---|
| 9,204,671 | B1 * | 12/2015 | Kessler, III | A41B 1/08 |
| 2005/0066425 | A1 * | 3/2005 | Kozlarek | A41B 1/14 2/256 |
| 2014/0345031 | A1 | 11/2014 | Reidsema et al. | |
| 2015/0313289 | A1 * | 11/2015 | Lester | A41B 3/06 223/2 |
| 2016/0100634 | A1 * | 4/2016 | Rogers | A41B 1/02 2/256 |

* cited by examiner

APPARATUS TO ENHANCE SHIRT COLLAR APPEARANCE

CROSS REFERENCE TO RELATED APPLICATIONS

This application is a non-provisional of and claims priority to U.S. patent application Ser. No. 62/104,689 for Apparatus to Enhance Shirt Collar Appearance filed on Jan. 16, 2015. The same is incorporated herein by reference as if fully set forth below.

FIELD OF THE INVENTION

The invention relates to the field of clothing accessories worn to enhance the fit and appearance of a shirt, particularly a support structure worn under a shirt collar.

BACKGROUND

Collared shirts have long been a standard in both casual wear and more formal attire. Particularly in the art of menswear, the collar faces the wear and tear associated with lifting the collar to tie a necktie, arranging collar stays into the collar, as well as routine washing, ironing, or dry cleaning. After a very short while, a collar on shirt becomes worn and soft as the fabric breaks in. Although that adds to comfort, a worn collar is not as crisp and tidy appearing as many individuals prefer, particularly in regard to business attire. Collars on shirts that have been worn even a few times become limp as the fabric loses strength. The limp collar does not stay in place properly and folds over or moves out of center in reference to the wearer's face. As more and more men and women wear collared shirts without neckties for men or scarves for women, the collars on nicer dress shirts are worn open, exposing the wearer's neck. An open shirt allows for a more casual look, but most individuals would prefer that the open shirt collar stay in place with a stiff, well pressed appearance.

Accordingly, there is a need in the fashion and clothing industry for a device that assists in maintaining a desired position for a collar when a shirt is worn, and this is particularly true when a top button of the shirt is open.

SUMMARY OF THE INVENTION

In one embodiment, a shirt collar adjustment and support apparatus defines a curved body having a first edge and a second edge that converge to define an opening between two endpoints. One of said edges is tapered at respective ends toward the endpoints.

In another embodiment, a shirt collar adjustment and support apparatus defines a generally arced and substantially flat body that the body is a curve extending between first and second endpoints that define an opening between the endpoints. Respective first and second tapered sections extend from the respective first and second endpoints. The device includes a first edge having a first dimension extending from the first endpoint to the second endpoint, and a second edge has a second dimension extending between the tapered sections.

DETAILED DESCRIPTION

Figure 5:
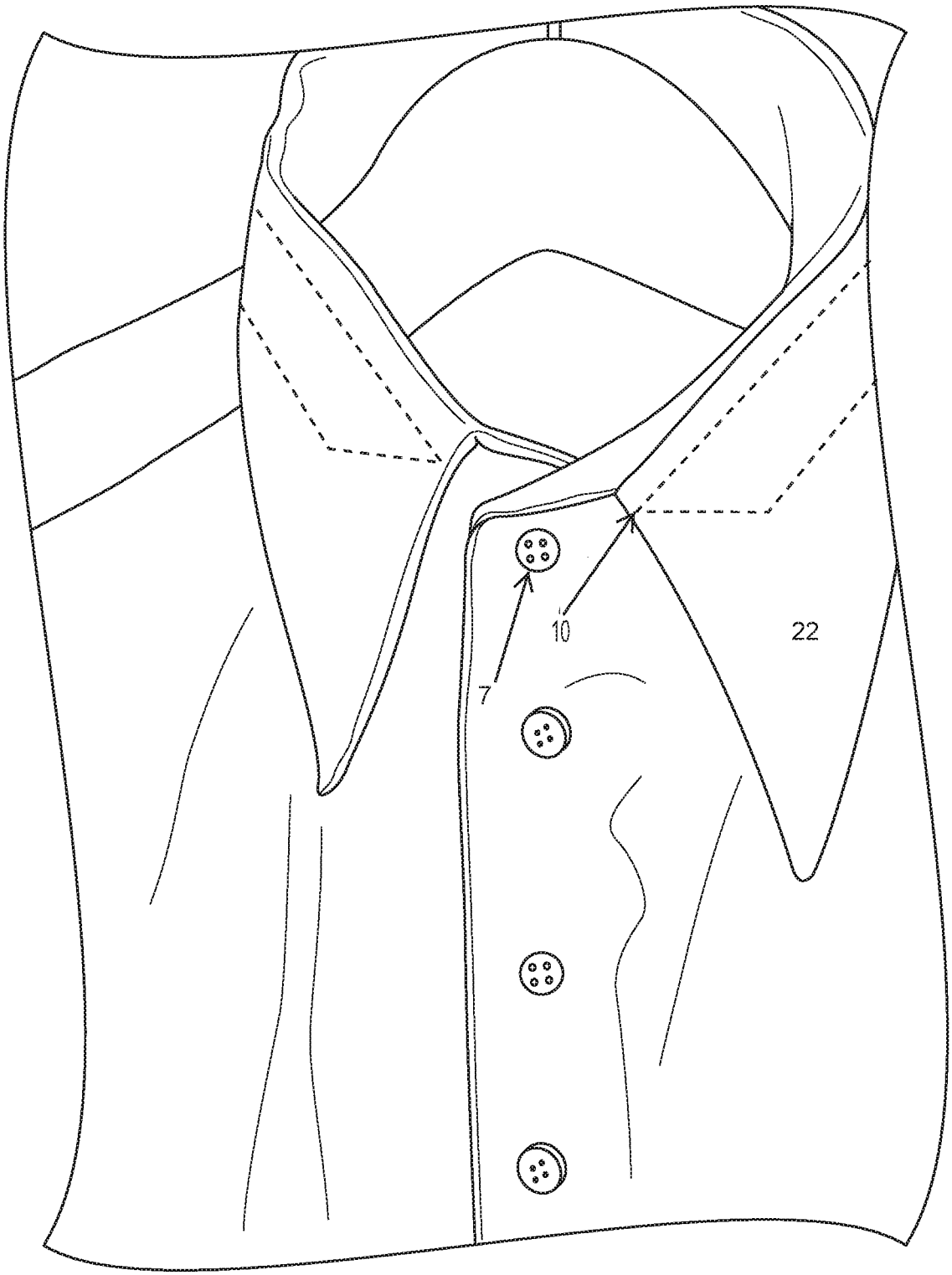
FIG. 5 is a front elevation view of a shirt collar held in place with the collar enhancement apparatus of FIG. 1.
Figure 6:
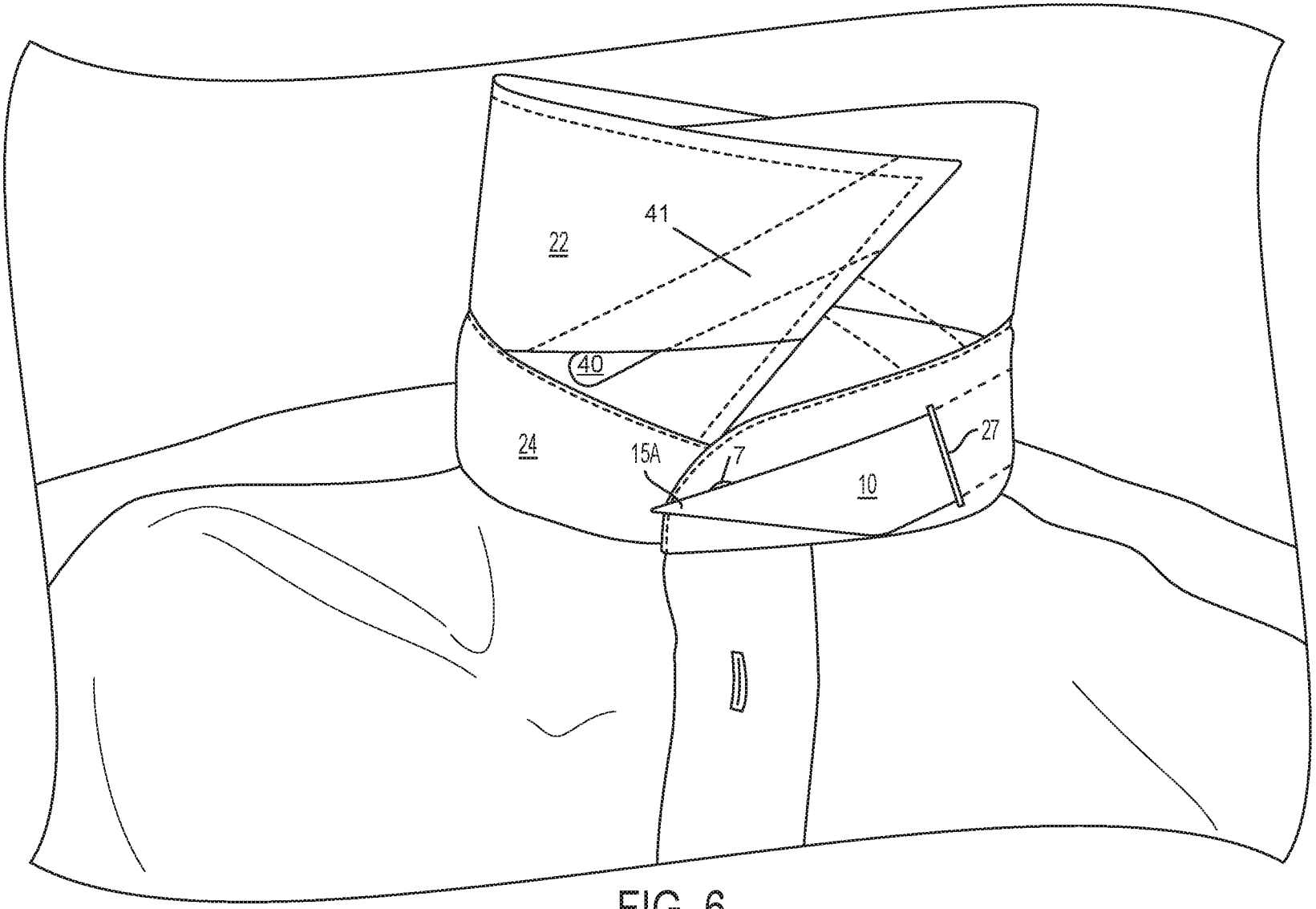
FIG. 6 is front elevation view of a dress shirt having a channel formed therein for holding a collar enhancement apparatus as shown in FIG. 1.
Figure 7:
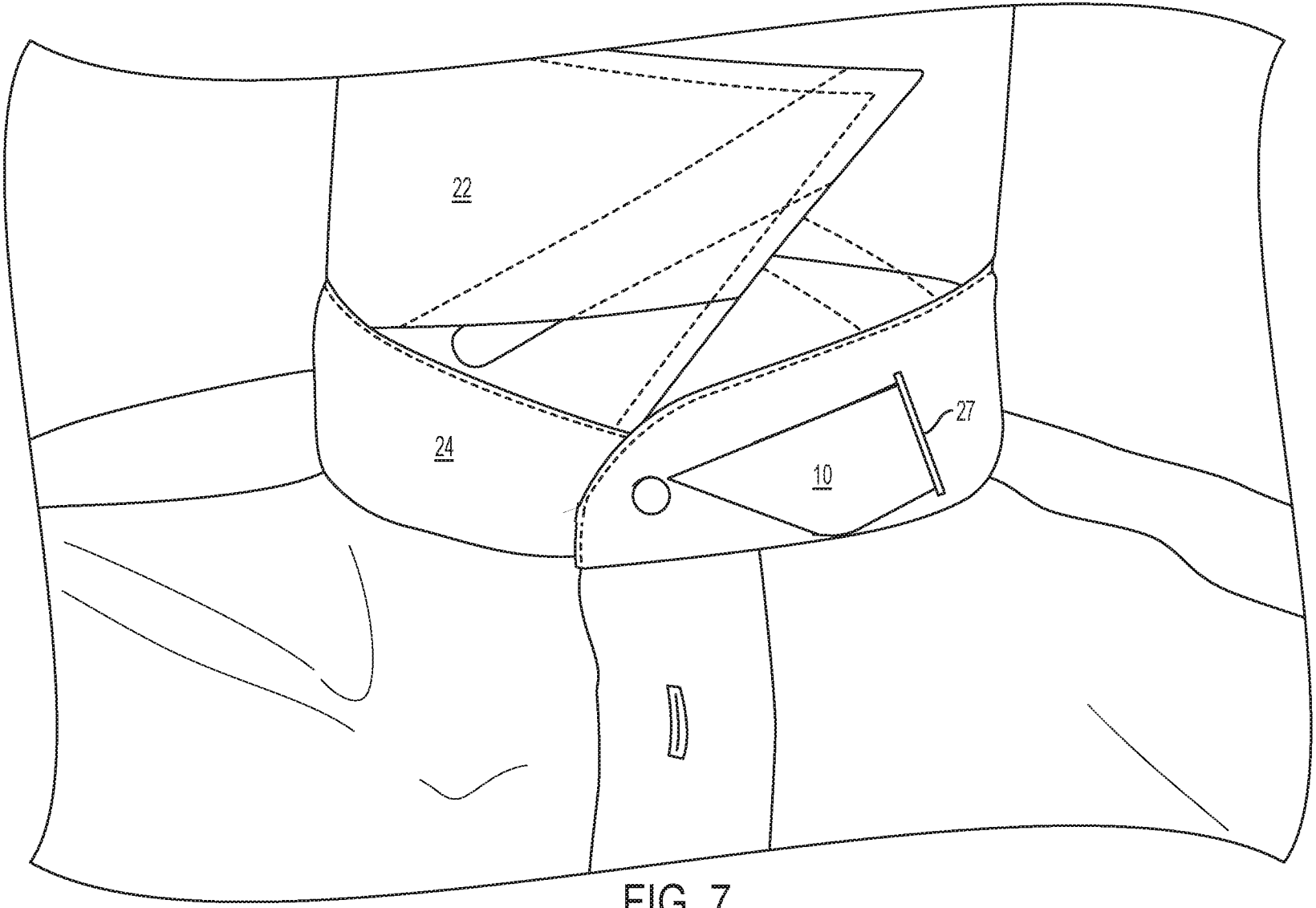
FIG. 7 is front elevation view of a dress shirt having a channel formed therein for holding a collar enhancement apparatus as shown in FIG. 1.
Figure 8:
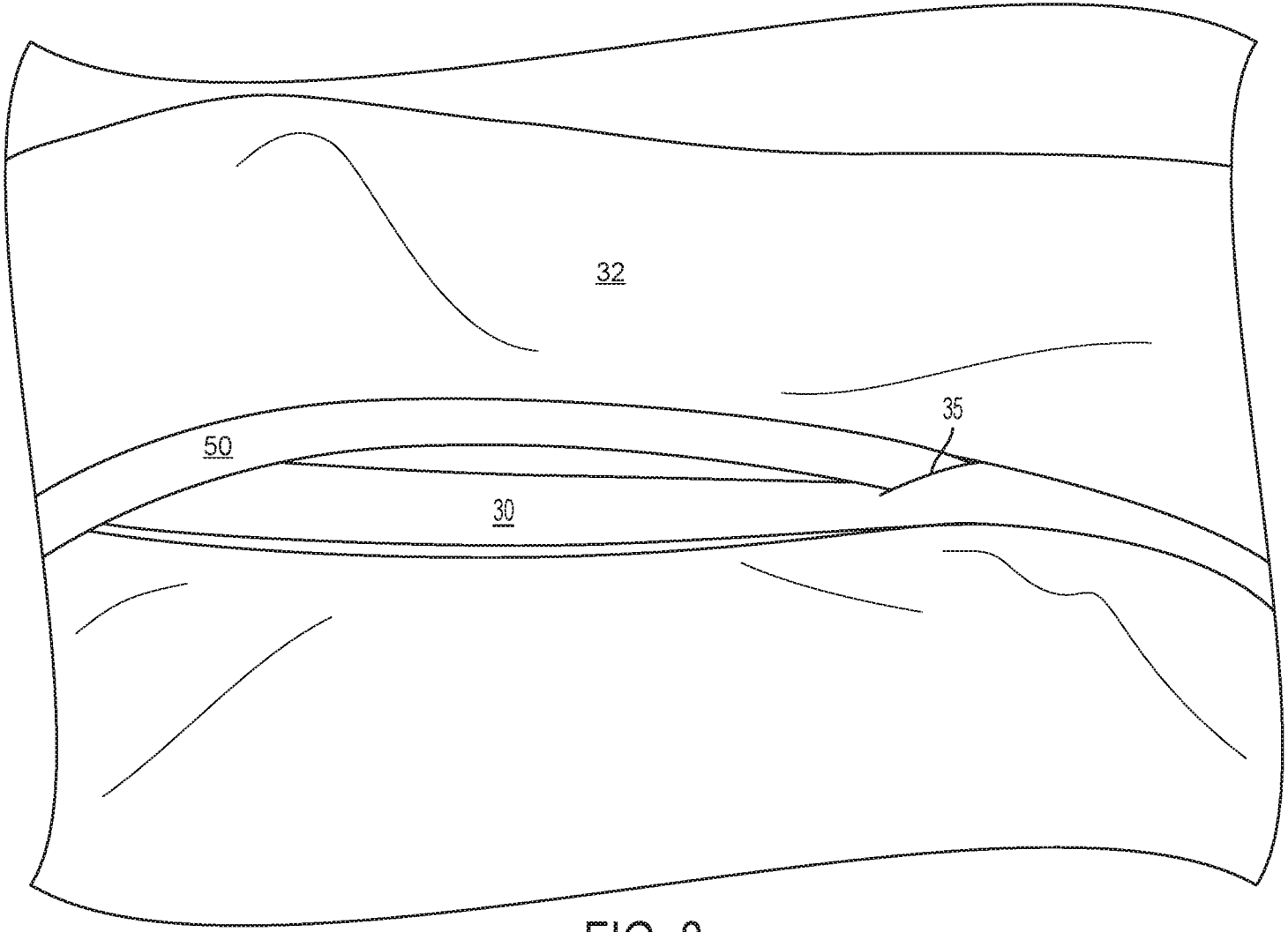
FIG. 8 is a front elevation view of a sports shirt having a channel formed therein for holding a collar enhancement apparatus as disclosed herein.
Figure 9:
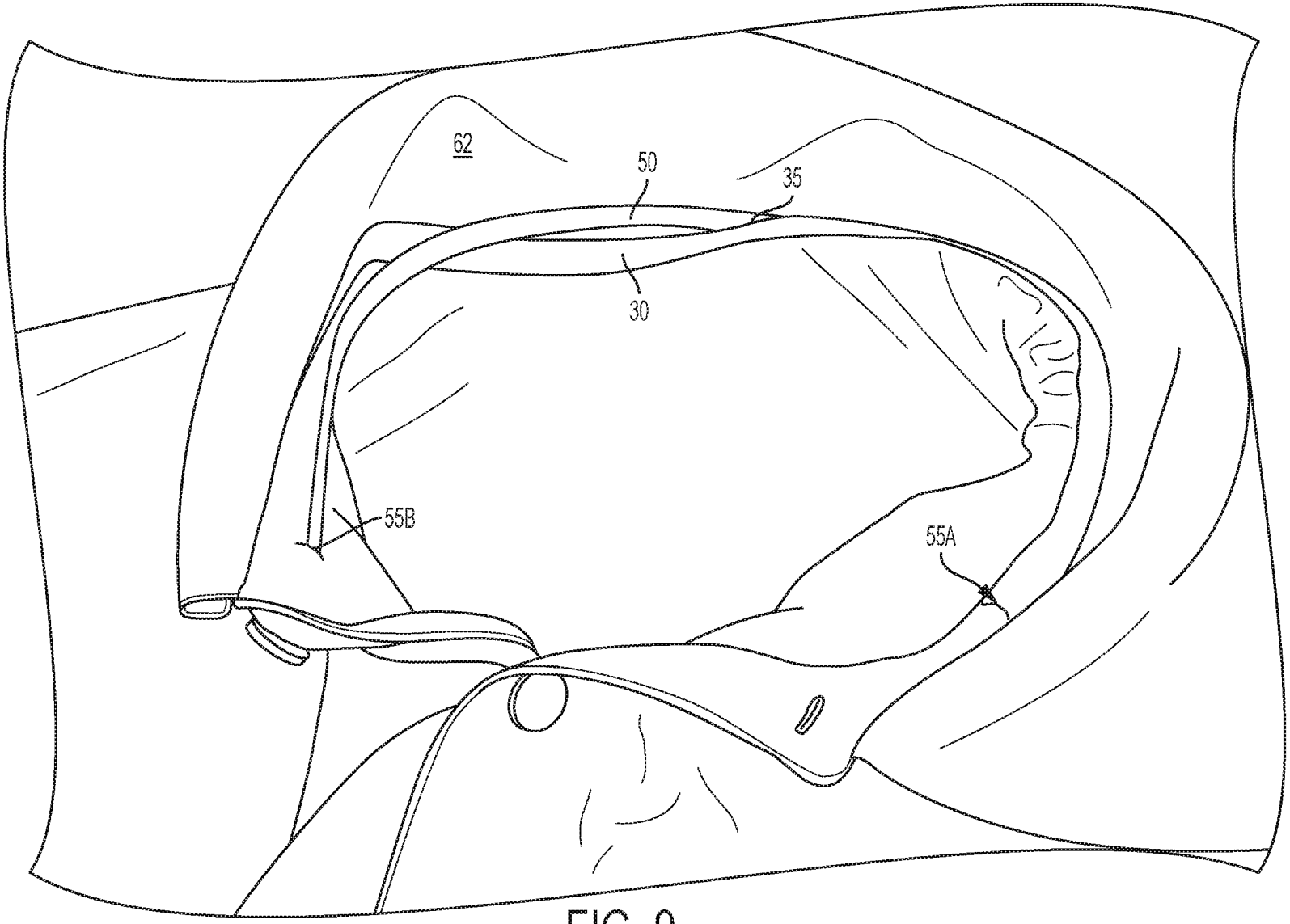
FIG. 9 is a top perspective view of a sports shirt have a channel formed therein for holding a collar enhancement apparatus as disclosed herein.
Figure 10:
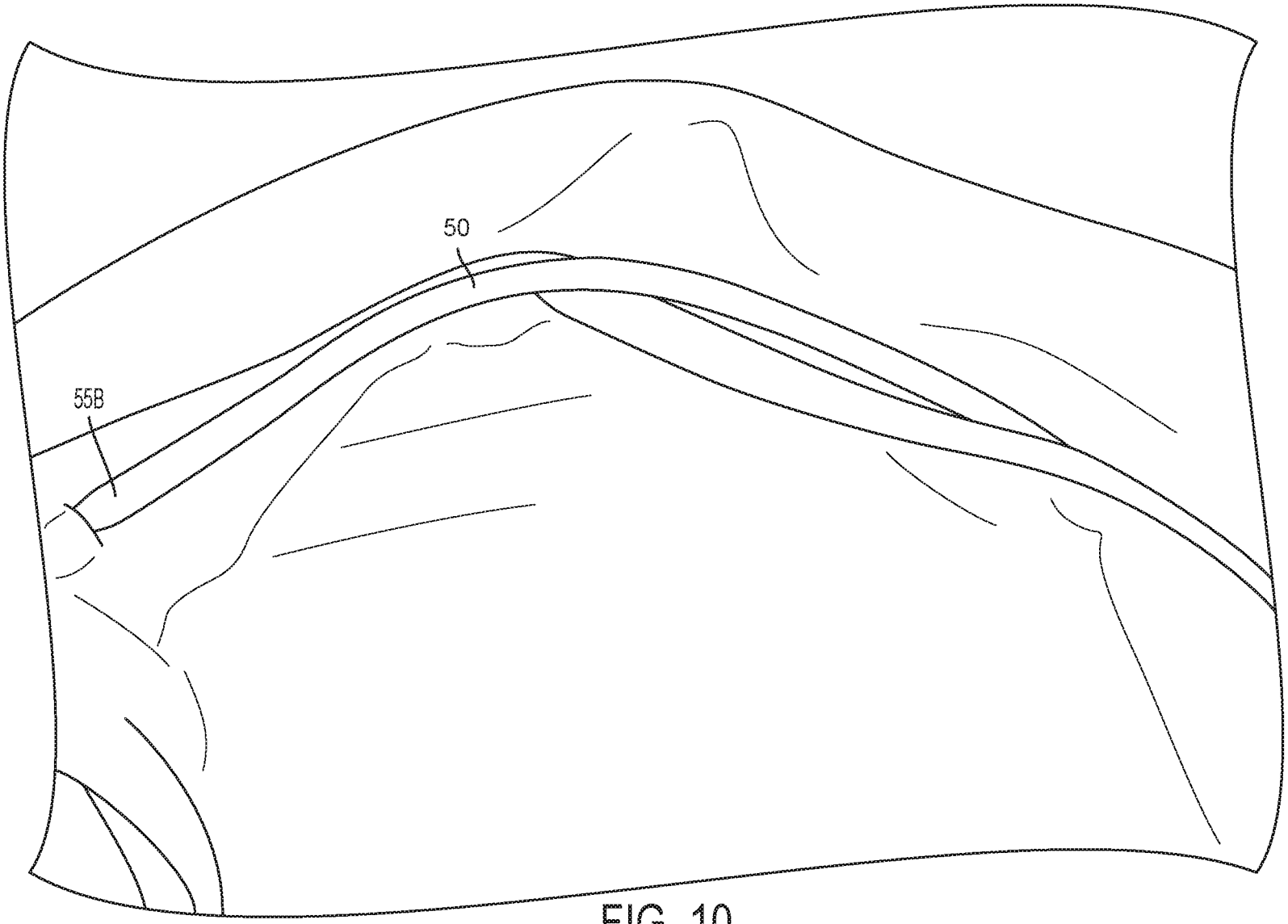
FIG. 10 is a top perspective view of the sports shirt and collar enhancement apparatus of FIG. 8 and FIG. 9.

The figures described above illustrate three embodiments of an apparatus that assists an individual in maintaining a well-tailored appearance about the collar (22) of a shirt (5) having a top button (7) that would fit into a respective button hole, unless the collar is worn open. FIGS. 1-5 are directed to a removable collar enhancement device (10), also referred to herein as a collar support device (10). that wraps around a user's neck between the shirt (5) and the shirt collar (22) such that the shirt collar (22) folds over the device (10); FIGS. 6-7 illustrate a device that may be inserted into a channel (27) formed within the fabric of the shirt (22), and FIGS. 8-10 illustrate an embodiment of an insertable collar enhancement device (50) in use within a channel (55) formed in the fabric of a sports shirt (a.k.a. the polo shirt (30)) having a flatter collar and requiring an internal collar support device (50).

The first embodiment of the collar enhancement apparatus (10) is a removable and possibly even disposable device shaped as an open arc, loop, or curved body. The loop is tapered at opposite ends defining tapered sections (15A, 15B) shown in FIG. 2 that each terminate in a substantially pointed or angled terminus referred to as endpoints (36A, 36B) of the device. The open loop allows the apparatus (10) to fit about the neck of a wearer on the outside of a shirt fabric (24) and hidden from view by the shirt collar (22) as shown in FIG. 3.

The apparatus (10) is so dimensioned such that the ends (15A, 15B) of the open loop are not visible when the user wears the apparatus (10) between the shirt fabric (24) and the collar (22), but the endpoints (36A, 36B) are as close as practicable to a top button (7) and corresponding top button hole on the opposite side of a worn shirt. By wearing the apparatus (10) in a stiffening position about the collar (22, 24) of a shirt (5) with the tapered ends (15A, 15B) pointing to and adjacent to the top button (7) and button hole of the shirt, the support device (10) improves the appearance of the shirt when the collar is unbuttoned (i.e., top button (7) is not inserted into a corresponding button hole).

The body of the device (10) is substantially uniform from top to bottom other than the tapered ends (15A, 15B). The curved body of the device (10) defines a first edge (13) and a second edge (14) that converge to define an opening between the two ends (15A, 15B), or endpoints (36A, 36B) of the device (10). The dimensions of the loop may vary as necessary but the width (W) of the loop along its longitudinal axis is consistent between the tapered ends (15A, 15B) and substantially dimensioned to match the area of fabric (24) under a dress shirt collar (22). The collar enhancement apparatus (10) may be made of numerous plastics, polymers, metals, papers, and combinations of the same (e.g., polypropylene), but in one embodiment the apparatus (10) is sufficiently flexible to maintain its flat and curved shape after many uses, even within shirt collars for different people of different sizes. The device (10) may be any color and may include artistic renderings thereon, and in one embodiment the device is clear (i.e., transparent) to ensure that it is less visible during use. The apparatus (10) is characterized in part by a resilient construction that returns to an original shape and size even upon stretching to widen an opening between the endpoints (36A, 36B). As shown in FIG. 5, the device is entirely hidden by the wearer's shirt collar, which remains in a stiff, tailored position during use. The flexible nature of the device (10) is configured to allow for widening the opening between the endpoints.

The device (10) defines a front face (60) and a back face (70) between the edges (13, 14) of the device, wherein the front face (60) is positioned between the back face (70) and the opening between end points (36A, 36B). The shirt collar adjustment and support device (10) is so dimensioned as to fit under a shirt collar in a manner that the curved body of the apparatus is not visible under the shirt collar.

Figure 1:
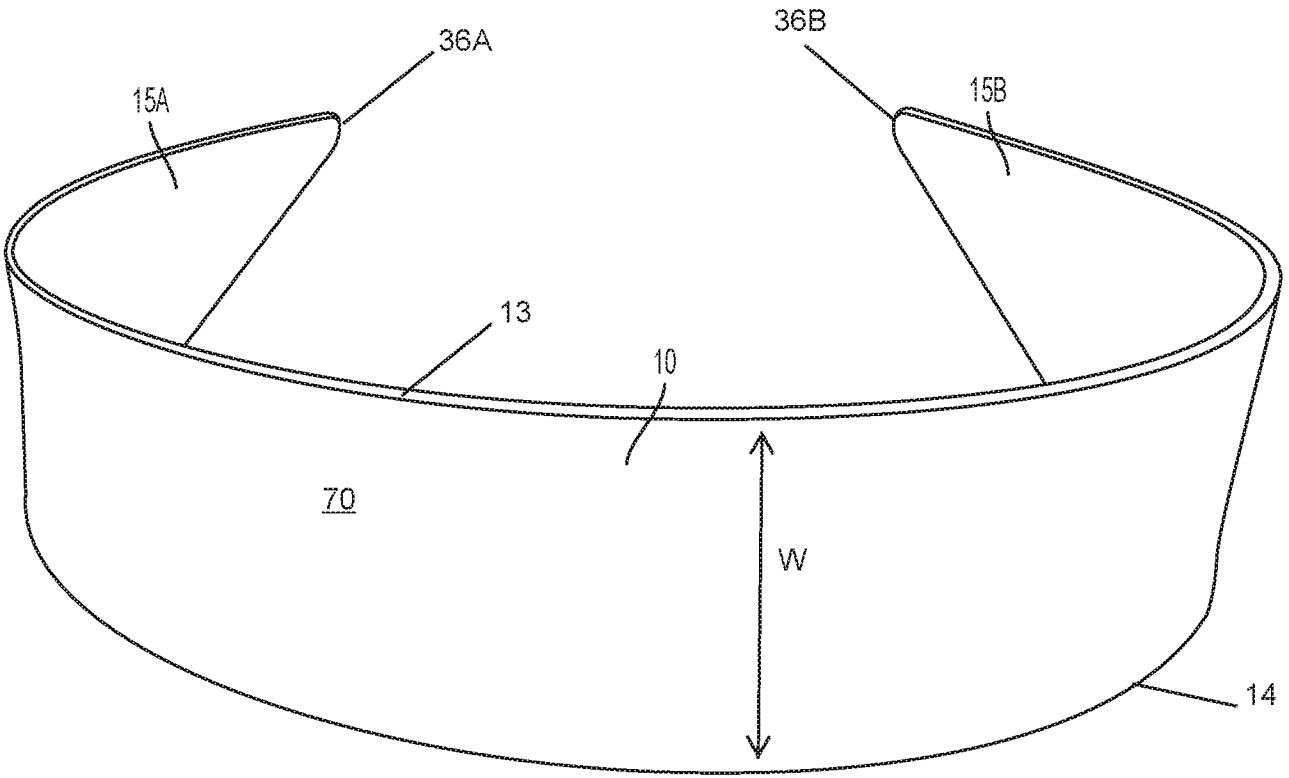
FIG. 1 is a rear perspective view of a collar enhancement apparatus as disclosed herein.
Figure 2:
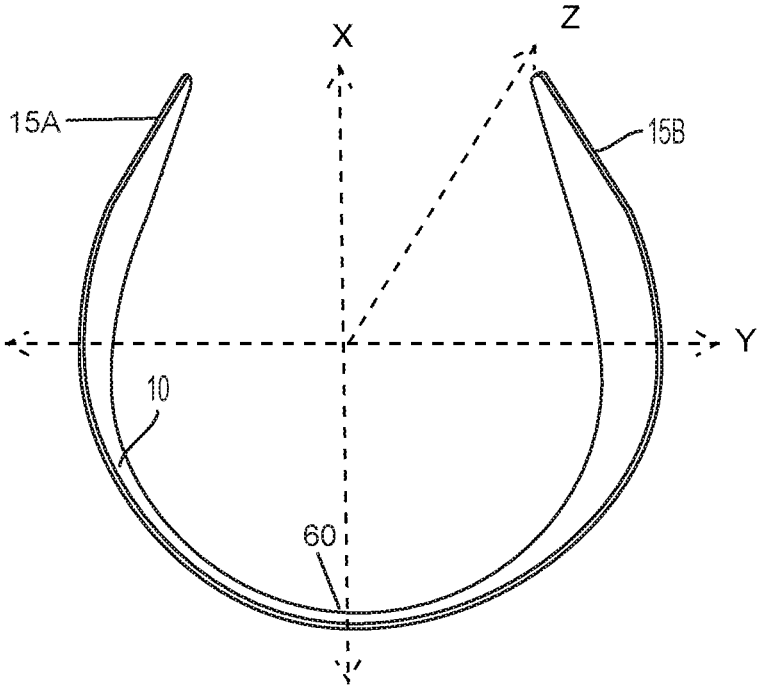
FIG. 2 is a top plan view of a collar enhancement apparatus as shown in FIG. 1.
Figure 3:
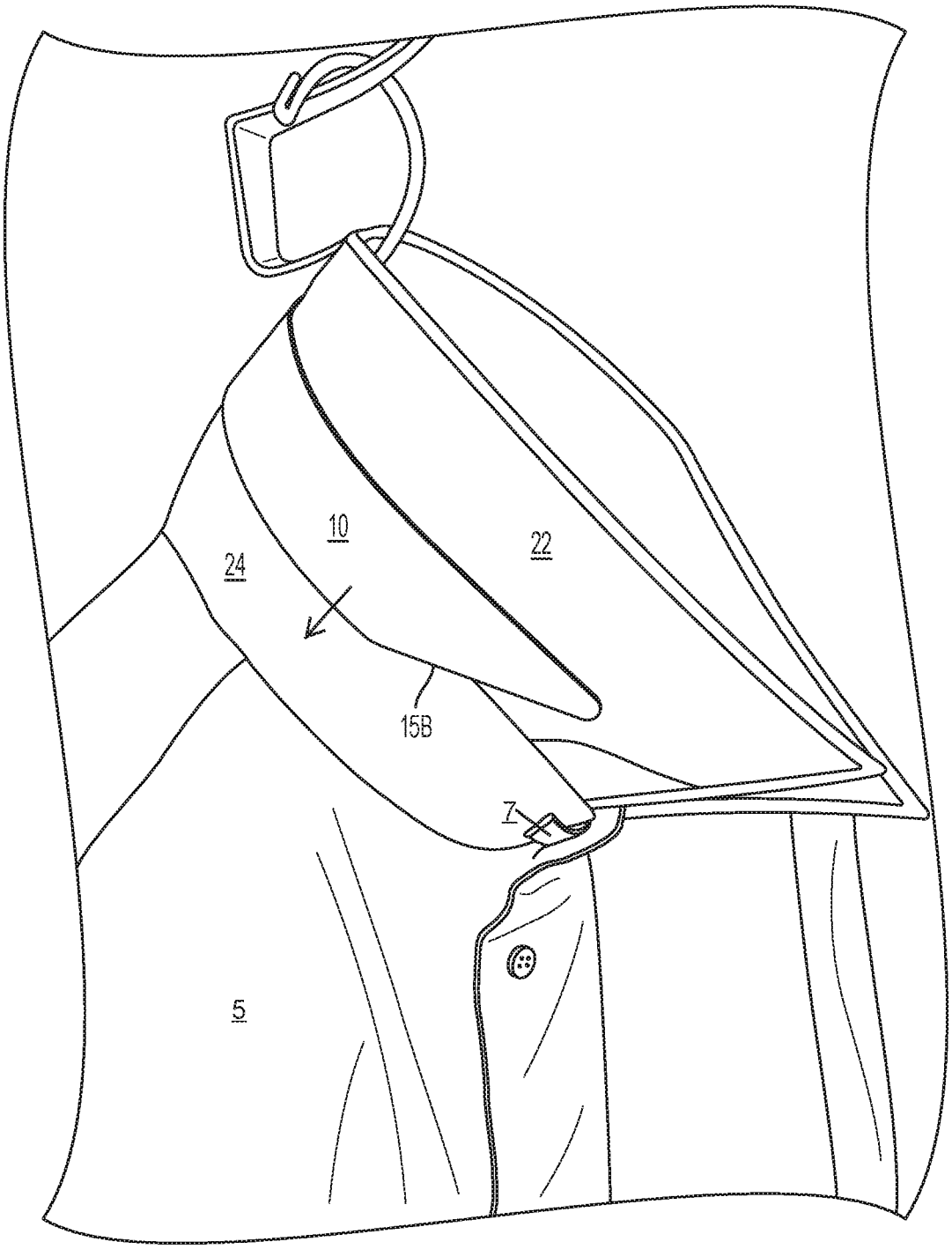
FIG. 3 is a side elevation view of the collar enhancement apparatus as shown in FIG. 1 and in place on a shirt as a work piece.
Figure 4:
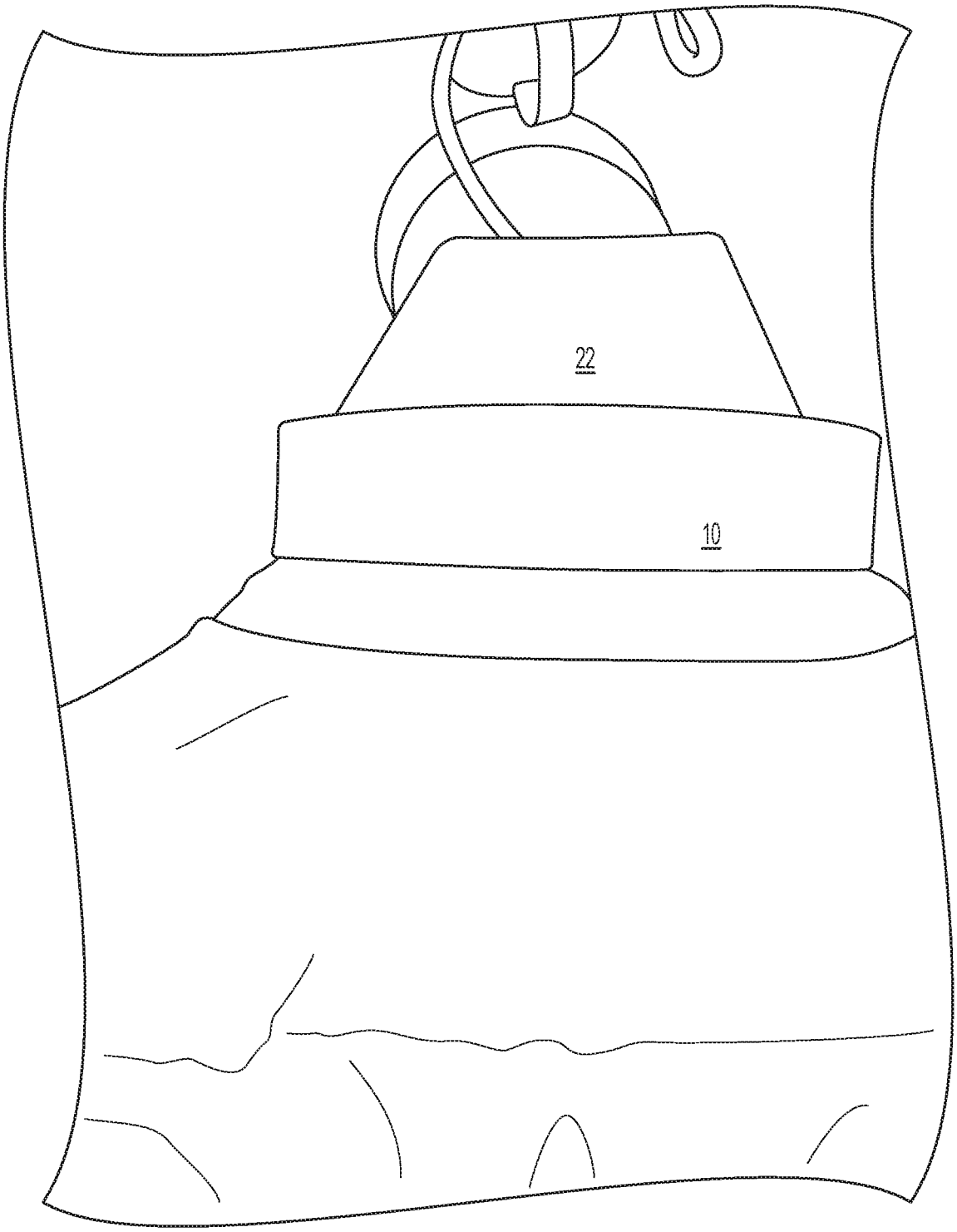
FIG. 4 is a side elevation view of the collar enhancement apparatus as shown in FIG. 1 and in place on a shirt as a work piece with the collar extended upward.

One way to describe the device (10) is in terms of a Cartesian coordinate system shown in FIG. 2 in which a point of origin is centered at a point in space within the arced body of the device (10). In this example, an x axis would intersect the device only once, the y axis would intersect the device in two places on opposite sides, and the z axis would extend through the origin without intersecting the device. In one embodiment, the curved body defines an arc wherein the opening between the endpoints (36A, 368) is between 30 degrees and 330 degrees on the x-y Cartesian coordinate system defining an origin at the center of the space encircled by the arc of the device body (10). A stable state of the curved body (10) defines an opening between 20 degrees and 340 degrees. An expanded state of the curved body defines an opening between 50 degrees and 310 degrees. The device (10) is configured for use with a shirt having a collar that folds toward a wearer's shoulders and back, the shirt collar adjustment apparatus being positionable around the wearer's neck with said endpoints (36A, 368) proximate a top button (7) on the shirt (5). The tapered ends (15) of the device (10) extend from a front top button (7) on the shirt toward a wearer's shoulder. The opening defined between the ends expands to allow the wearer to fit the shirt collar adjustment apparatus around the wearer's neck such that the shirt is between the wearer's body and the shirt collar adjustment apparatus.

In another embodiment, shown first in FIGS. 6 and 7, a shirt may be manufactured with a channel (27) about the neckline of the shirt under the collar (22). The channel (27) has an opening that allows the collar enhancement device (10) to slide there through and hold the neckline upright so that upon folding the collar (22) down over the outer wall (24) of the channel, the collar has better support from the internally positioned device (10). In this embodiment, the tapered edges (15) (exposed to show a sliding motion into the channel) assist the user or manufacturer in positioning the device into the channel.

FIGS. 8-10 illustrate the same concept of FIGS. 6-7 but with a channel (30) formed in a sports or polo shirt having a collar (32) above the neckline channel (30). As shown at Ref. 55B, the terminus of each end of this embodiment, may be flat or tapered depending upon the necessity to avoid picking the fabric with an angular end.

These and other details of the invention are set forth in the drawings and claims that follow.

The invention claimed is:

1. A shirt collar adjustment apparatus, the apparatus comprising:

a curved body defining a first edge and a second edge that converge to define an opening between two endpoints;

tapered ends in the curved body that are respectively defined by the first edge and the second edge converging toward the endpoints, wherein each of the endpoints comprises a flat terminus;

a consistent width between the tapered ends of the curved body, the consistent width extending between the first edge and the second edge, wherein the consistent width extends from top to bottom of the curved body other than the tapered ends;

a front face and a back face between said edges, wherein said front face is positioned between said back face and the opening, and wherein said front face and said back face are uninterrupted flat surfaces.

2. A shirt collar adjustment apparatus according to claim 1, wherein said curved body is flexible and configured to allow for widening the opening between said endpoints.

3. A shirt collar adjustment apparatus according to claim 1, wherein said curved body comprises a plastic.

4. A shirt collar adjustment apparatus according to claim 3, wherein said plastic comprises polypropylene.

5. A shirt collar adjustment apparatus according to claim 1, wherein said curved body is made of a clear plastic.

6. A shirt collar adjustment apparatus according to claim 1, wherein said curved body defines an arc wherein the opening is between 30 degrees and 330 degrees relative to a center of the arc.

7. A shirt collar adjustment apparatus according to claim 6, wherein a stable state of the curved body defines an opening between 20 degrees and 340 degrees.

8. A shirt collar adjustment apparatus according to claim 6, wherein an expanded state of the curved body defines an opening between 50 degrees and 310 degrees.

9. A shirt collar adjustment apparatus according to claim 1 used with a shirt having a collar that folds toward a wearer's shoulders and back, the shirt collar adjustment apparatus being positionable around the wearer's neck with said endpoints proximate a top button on the shirt.

10. A shirt collar adjustment apparatus according to claim 9, wherein each respective endpoint extends from a front button on the shirt toward a wearer's shoulder.

11. A shirt collar adjustment apparatus according to claim 9, wherein the opening expands to allow the wearer to fit the shirt collar adjustment apparatus around the wearer's neck such that the shirt is between the wearer's body and the shirt collar adjustment apparatus.

12. A shirt collar adjustment apparatus consisting of:

an arced body that is flat and defines a curve;

a first endpoint of the arced body;

a second endpoint of the arced body, wherein the curve extends between the first endpoint and the second endpoint;

a first edge having a first dimension extending from said first endpoint to said second endpoint;

a second edge having a second dimension extending between said first endpoint and said second endpoint, wherein said first edge and said second edge converge to define an opening between the first endpoint and the second endpoint;

a front face and a back face between said edges, wherein said front face is positioned between said back face and the opening;

tapered ends in the flat body that are respectively defined by the first edge converging toward the second edge and terminating at the first endpoint and the second endpoint, respectively.

13. A shirt collar apparatus according to claim 12, wherein the flat body is elastic to expand the opening.

* * * * *